US010888498B2

(12) United States Patent
Henninger et al.

(10) Patent No.: US 10,888,498 B2
(45) Date of Patent: Jan. 12, 2021

(54) ADAPTER

(71) Applicant: sfm medical devices GmbH, Wächtersbach (DE)

(72) Inventors: Peter Henninger, Brachttal (DE); Markus Kehr, Biebergemünd (DE)

(73) Assignee: SFM MEDICAL DEVICES GMBH, Wächtersbach (DE)

( * ) Notice: Subject to any disclaimer, the term of this patent is extended or adjusted under 35 U.S.C. 154(b) by 7 days.

(21) Appl. No.: 16/306,121

(22) PCT Filed: May 3, 2017

(86) PCT No.: PCT/EP2017/060503

§ 371 (c)(1),
(2) Date: Nov. 30, 2018

(87) PCT Pub. No.: WO2017/211505

PCT Pub. Date: Dec. 14, 2017

(65) Prior Publication Data

US 2019/0142696 A1 May 16, 2019

(30) Foreign Application Priority Data

Jun. 8, 2016 (DE) ..... 10 2016 110 569

(51) Int. Cl.
*A61J 1/20* (2006.01)
*B65D 81/32* (2006.01)

(52) U.S. Cl.
CPC ..... *A61J 1/2096* (2013.01); *A61J 1/201* (2015.05); *A61J 1/2048* (2015.05); *A61J 1/2086* (2015.05);

(Continued)

(58) Field of Classification Search
CPC ..... A61J 1/2096; A61J 1/201; A61J 1/2048; A61J 1/2086; A61J 1/2055; B65D 81/3211

(Continued)

(56) References Cited

U.S. PATENT DOCUMENTS 5,060,704 A 10/1991 Rohrbough
5,350,372 A * 9/1994 Ikeda ..... A61J 1/2089 141/329

(Continued)

FOREIGN PATENT DOCUMENTS

JP 2011-224223 A 11/2011
WO 2003/000170 A1 10/2004
WO WO-2016107811 A1 * 7/2016 ..... A61J 1/2089

OTHER PUBLICATIONS

International Search Report, dated Aug. 3, 2017, corresponding to International Application No. PCT/EP2017/060503.

(Continued)

*Primary Examiner* — Jessica Cahill
*Assistant Examiner* — Christopher M Afful
(74) *Attorney, Agent, or Firm* — Ladas & Parry LLP; Malcolm J. MacDonald

(57) ABSTRACT

An adapter (14) for transferring a substance from a first container (10) into a second container, having a circumferential wall (47) suitable for housing the first container, along which a cannula body (64) extends and by which said cannula body is coaxially surrounded at least in part, said adapter also comprising a hollow cylindrical section (26) connected to the cannula body and connectable to the second container. The cannula body extends with the longitudinal axis thereof perpendicular to one side of a wall (24) running transversely with respect to the circumferential wall and the hollow cylindrical section extends with the longitudinal axis perpendicular to the other side of the wall. The adapter (14)

(Continued)

has a cup-shaped outer body (18) having an outer circumferential wall (32) and the wall (24), running transversely to the longitudinal axis of the outer body, which has an insert (46) having the circumferential wall (47).

16 Claims, 7 Drawing Sheets

(52) U.S. Cl.
CPC ..... *B65D 81/3211* (2013.01); *A61J 1/2055* (2015.05)

(58) Field of Classification Search
USPC ..... 604/403
See application file for complete search history.

(56) References Cited

U.S. PATENT DOCUMENTS 5,879,345 A * 3/1999 Aneas ..... A61J 1/2089 215/277
5,924,584 A * 7/1999 Hellstrom ..... A61J 1/2096 215/247
6,558,365 B2 5/2003 Zinger et al.
6,948,522 B2 * 9/2005 Newbrough ..... A61J 1/2089 137/550
8,857,470 B2 * 10/2014 Rahimy ..... A61J 1/2089 137/798
8,869,635 B2 10/2014 Daniel et al.
10,058,482 B2 8/2018 Haindl et al.
10,426,702 B2 * 10/2019 Henninger ..... A61J 1/2089
2002/0087141 A1 * 7/2002 Zinger ..... A61J 1/2089 604/414
2005/0033260 A1 * 2/2005 Kubo ..... A61J 1/2089 604/411
2012/0323210 A1 * 12/2012 Lev ..... A61J 1/2089 604/405
2014/0000738 A1 1/2014 Reynolds et al.
2014/0166511 A1 * 6/2014 Tuckwell ..... A61J 1/2096 206/222
2015/0034178 A1 * 2/2015 Vasquez ..... F16K 17/04 137/471
2015/0112296 A1 * 4/2015 Ishiwata ..... A61J 1/1406 604/406
2015/0231034 A1 8/2015 Lev et al.
2015/0297459 A1 * 10/2015 Sanders ..... A61J 1/1406 604/414
2016/0081878 A1 3/2016 Marks et al.

OTHER PUBLICATIONS

Non-English European Office Action dated Oct. 4, 2019, in EP Application No. 17 721 142.2.
Canadian Office Action, dated Apr. 7, 2020, in Canadian Application No. 3,026,160.
Japanese Office Action, dated Oct. 20, 2020, and English translation of JP Office Action, corresponding to Japanese Application No. 2019-517143.

* cited by examiner

ADAPTER

The invention relates to an adapter for transferring a substance from a first container into a second container, such as a syringe body, comprising a circumferential wall, which is suitable for holding the first container, and along said wall and at least in sections encompassed by said wall, extends a cannula body, further comprising a hollow-cylindrical section, which is in communication with the cannula body, and which can be connected to the second container, whereby the cannula body with its longitudinal axis extends perpendicular to one side of a wall that extends transversely to the circumferential wall, and the hollow-cylindrical sections with its longitudinal axis extends perpendicular to the other side of the wall.

U.S. Pat. No. 6,558,365 discloses a device for mixing fluids present in containers that consists of two adapters, which are connected in the manner of a screwed connection via Luer Lock connectors. This also allows connecting the adapter, which comprises a female Luer Lock connector, to a syringe body.

Described in DE 10 2012 113 002 A1 is a transfer device for withdrawal or transfer of a fluid, comprising a first and a second component, displaceable relative to the first component along the direction of the longitudinal axis. In order to facilitate displacing the components relative to each other, one of the components must encompass the opening area of a container.

It is the objective of the present invention to further develop an adapter of the type mentioned above, so that said adapter is easy to handle, offers adequate stability, and in particular it is ruled out that any handling of the outside of the adapter could inadvertently change the position of the container—also referred to as vial—accommodated in the adapter. In addition, if necessary, there should be an option to use simple measures to adapt to containers of different sizes.

The option to filter a prepared medicinal product should also be available.

To meet this objective or of individual aspects thereof, it is essentially intended that the adapter possesses a cup-shaped outer body with an outer circumferential wall and the wall, which extends transversely relative to the longitudinal axis of the outer body, and that the cup-shaped outer body possesses an insert that comprises the circumferential wall, which accepts the container.

The invention in particular is characterized by an adapter that comprises a cup-shaped outer body with an outer circumferential wall and the wall that extends transversely to the longitudinal axis of the outer body, and by that the cup-shaped outer body comprises an insert with the circumferential wall that accepts the container, whereby the cannula body originates from the bottom wall of the insert and the hollow-cylindrical section originates from the wall of the cup-shaped outer body.

In this context, the term 'cup-shaped' is intended to mean that the outer body along its circumference in principle possesses a hollow-cylinder geometry, even if the outer body may possess on its exterior side a geometry that differs from that. In particular, the term 'cup-shaped outer body' also includes an outer body with an exterior geometry of for example a polygonal column, such as a parallelepiped. Therefore the term cup-shaped is to be understood as a synonym. However, the term cup-shaped outer body in particular is meant to imply that the outer body possesses an interior cylindrical geometry.

Furthermore, the outer body should be free of slits on its circumference, which means that different from the prior art there are no slits, which increase flexibility, originate from the front edge, and extend along the longitudinal direction of the adapter. Therefore the outer body can be considered closed along its circumferential side.

Further, the outer body is bordered at one of its end faces by a wall, which also is referred to as end wall. The latter should extend perpendicular to the longitudinal axis of the outer body.

Different from other prior-art designs, the invention intends that for the container (vial) a separate receptacle is provided, which forms an insert and which is situated within the cup-shaped or hollow-cylindrical outer body, which could be referred to as a housing, so that the outer body can consist of a comparatively rigid material, in particular a plastic material, that maintains its geometry when the outer body is handled. In contrast, adapters according to the state of technology possess along their circumference sections that are separated by slits, so that the adapter components are sufficiently flexible along the circumference in order to accept a vial.

The outer body and the insert form a unit. The outer body and the insert are not movable relative to each other along the longitudinal direction. For this purpose, the outer body and the insert are connected to each other, in particular by a material bond. The unit created in this manner is pushed onto a vial or a vial is introduced into the unit. No relative displacement along the direction of the longitudinal axis takes place between the outer body and the insert.

Having the vial accepted into the insert, which is connected to and forms a unit with the outer body, creates a modular design with the result that without any changes in the geometry of the outer component, i.e. the cup-shaped outer body, inserts of different cross-sections can be inserted to match vials of different dimensions, to secure these in position to the necessary degree. Prior to accepting a vial, the outer body and the insert are of course connected, in particular by a material bond, even though for example a snap-fit connection or other connection is also feasible.

The cup-shaped or hollow-body-shaped outer body of the adapter forms a housing that at least in sections of its exterior side can possess a cylindrical geometry.

As a result of the modular structure, i.e. the insert that can be inserted in and in particularly be connected by material bond to the cup-shaped or hollow-cylindrical body, one also realizes the advantage that a filter element can easily be positioned and secured in position between the bottom wall of the insert and the wall that forms a bottom delimiting wall or transverse delimiting wall of the cup-shaped or hollow-cylindrical outer body. This filter element may be connected, i.e. welded, to the exterior surface of the bottom wall of the insert in advance, so that subsequently the insert can be connected by material bond to the wall of the cup-shaped or hollow-cylindrical outer body, in particular by means of ultrasonic welding, in a manner so that the bottom wall is connected to the wall in a fluid-tight manner. This ensures that when the adapter is connected to the second container, in particular a syringe body, the fluid flowing through the hollow-cylindrical section, which in particular is embodied as a Luer connector, can flow from a vial into the second container exclusively via the filter.

If a filter is included, then this filter should be embodied as a two-dimensional filter. In this, the filter fabric is placed between two surfaces. To facilitate a uniform distribution of the fluid, the entire surface along which the filter fabric extends, can be provided with regular centrically extending depressions. Supply and discharge of the fluid preferably takes place via four symmetrically arranged and centrally extending channels, which guide the fluid to a central depression.

The projections in the surface serve as a support for the fabric, and consequently as a support surface.

The female Luer connector allows a problem-free withdrawal of the prepared medicinal product without the need for a metal cannula. Consequently the device offers a needle-free transfer.

For securing the container (vial) in position, it is in particular intended that the circumferential wall of the insert, which in particular is encompassed concentrically by the outer circumferential wall of the outer body, e.g. housing, comprises projections that extend radially into the interior of the insert for securing the container, whereby the circumferential wall at least in the area of the projections extends at some distance from the outer circumferential wall. Preferably the circumferential wall is completely covered by the outer circumferential wall, but at the very least it is covered in the area of the projections.

The projections in particular serve to engage behind the beadlike rim of the vial. In order for the elastic bendable projections, which originate from wall sections of the circumferential wall, to be movable to the required degree, the circumferential wall extends at least in the region of the projections at some distance from the outer circumferential wall. In particular it is intended that the entirety of the circumferential wall extends spaced apart from the outer circumferential wall.

In order to facilitate an uncomplicated alignment of the insert relative to the adapter, a further development of the invention intends that the hollow cylindrical section, e.g. embodied as a Luer connector, originates from the wall of the housing. In contrast, the hollow-needle body, which can also be referred to as cannula body and preferably is embodied as a plastic spike, extends in the opposite direction from the hollow-cylindrical section, namely from the bottom wall into the interior of the insert that has been accommodated in the housing.

Having the cannula body or spike originate from the bottom wall of the insert facilitates a problem-free positioning of a filter between the insert and the housing.

The outer bottom surface of the insert, along which extends the filter, should be textured, to prevent two-dimensional contact of the filter element.

As a further development, the invention intends that the insert comprises a first cylindrical section extending along the bottom side and transitioning from this said first section via a step into a second section, which possesses a great outer diameter and forms the circumferential wall.

Independently thereof, it is particularly intended that the insert is connected to the hollow-body-shaped outer body fluid-tight along the circumference, whereby the invention in particular envisions a material-bond connection, which can be created by ultrasonic welding.

The cup-shaped outer body and the insert present within it in particular are embodied as injection-molded components.

Further details, advantages, and features are not only found in the claims, the characteristic features mentioned therein—individually and/or in combination—but also in the following description of a preferred embodiment example illustrated in the figures.

The figures show:

Figure 1:
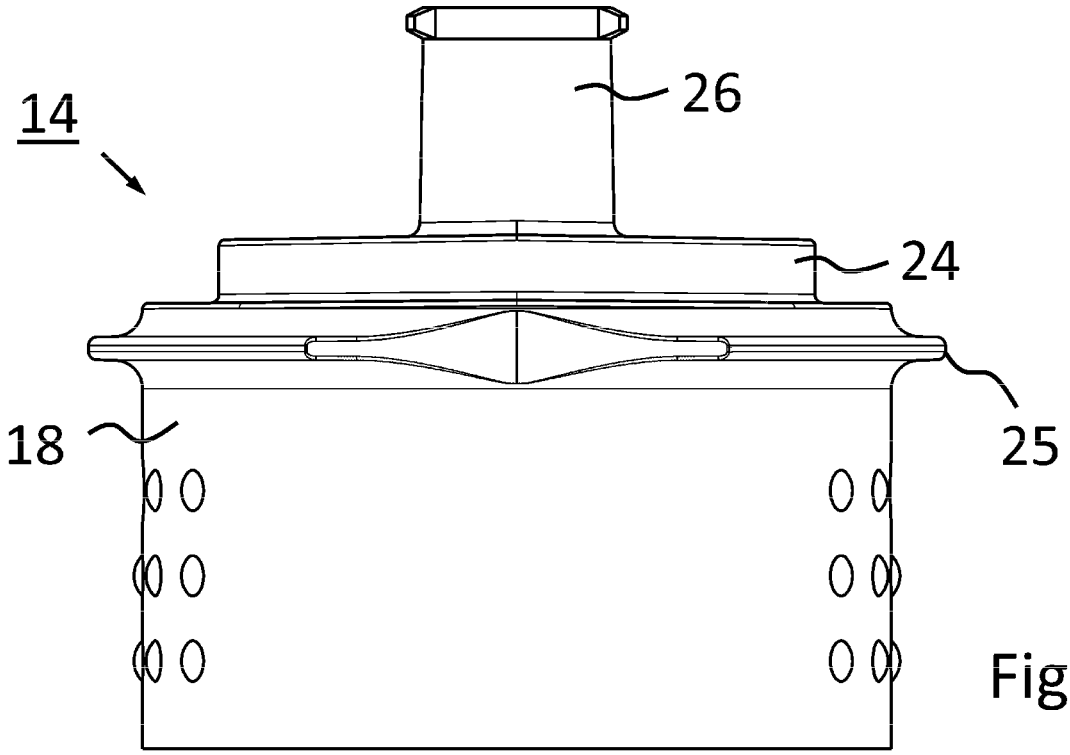
FIG. 1 shows a lateral view of an adapter.
Figure 2:
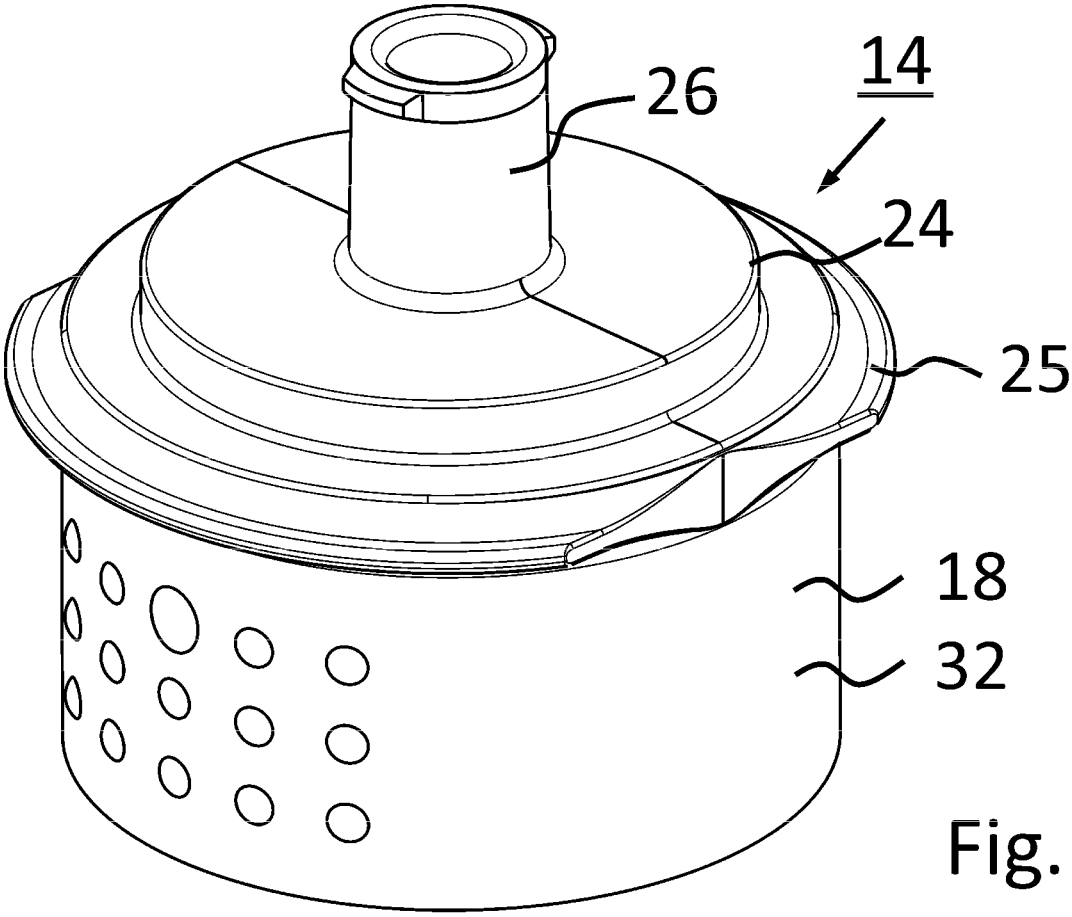
FIG. 2 shows a perspective view of the adapter of FIG. 1.

The figures, where identical elements always are referred to by the same reference labels, show schematic diagrams of an adapter 14. The adapter 14 serves to accept a container or small bottle, which is also referred to as vial 10. The adapter 14 further is to be connected to a second container, in particular a syringe body 12, in order to withdraw a medicinal substance from the vial 10 that is attached to the adapter 14.

The adapter 14 comprises a cup-shaped outer body 18, which is to be referred to as a housing, and which consists of an outer circumferential wall with a hollow-cylindrical geometry and, as a termination on the former's end face, a wall 24. In the embodiment example, the outer circumferential wall 32 is closed along its circumference and in particular consists of a dimensionally stable plastic. This provides a dimensional stability of such a type that when the outer wall engages with the adapter 14, the former is substantially non-deformable. Naturally it is still within the scope of the invention, if the outer geometry of the circumferential wall 32 deviates from a cylindrical geometry. However, the inner geometry of the outer body 18 should be cylindrical.

The wall 24, hereinafter also referred to as end wall, merges via a step 24 into a radially projecting rim 25, which protrudes from the circumferential wall 32 and forms a collar. As is illustrated in the figures, the rim 25 is flattened on diametrically opposed sides. This makes it possible handle the housing, i.e. the outer body 18, without any problems. At the same time, this prevents the device from inadvertently rolling away.

Projecting outward from the end wall 24 is a hollow-cylindrical section 26 that may be embodied as a female Luer Lock connector. The latter serves to connect to the second container, i.e. the syringe body 12.

Figure 3:
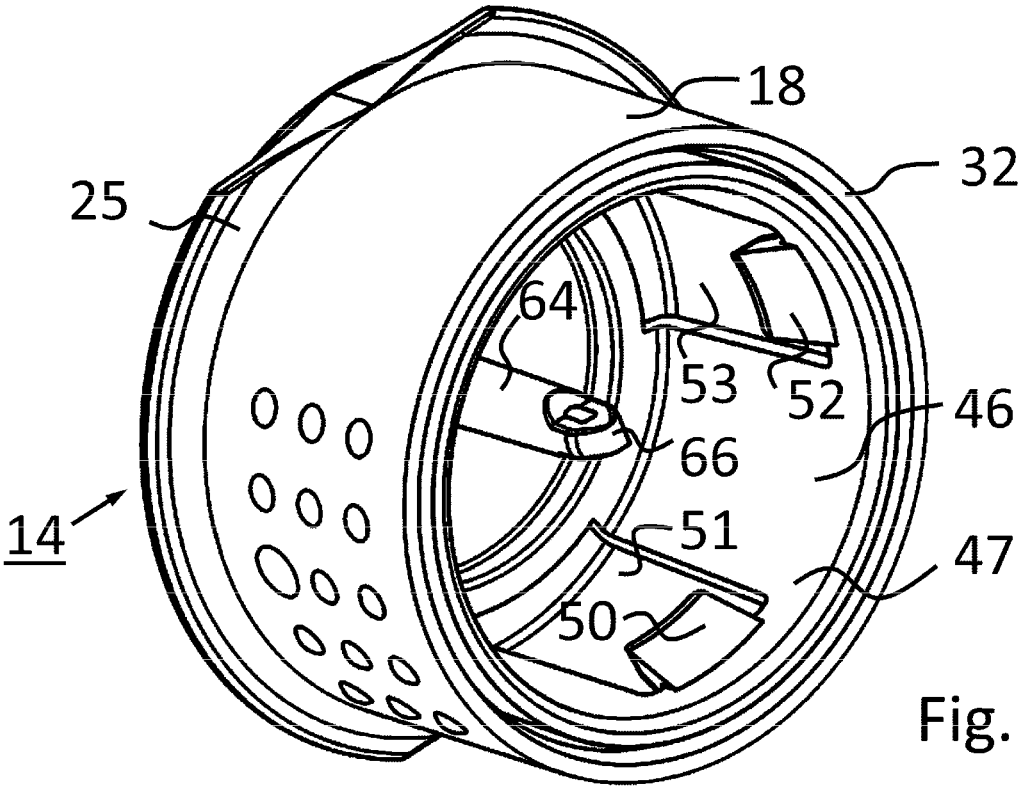
FIG. 3 shows a partial interior view of the adapter of FIGS. 1 and 2.
Figure 4:
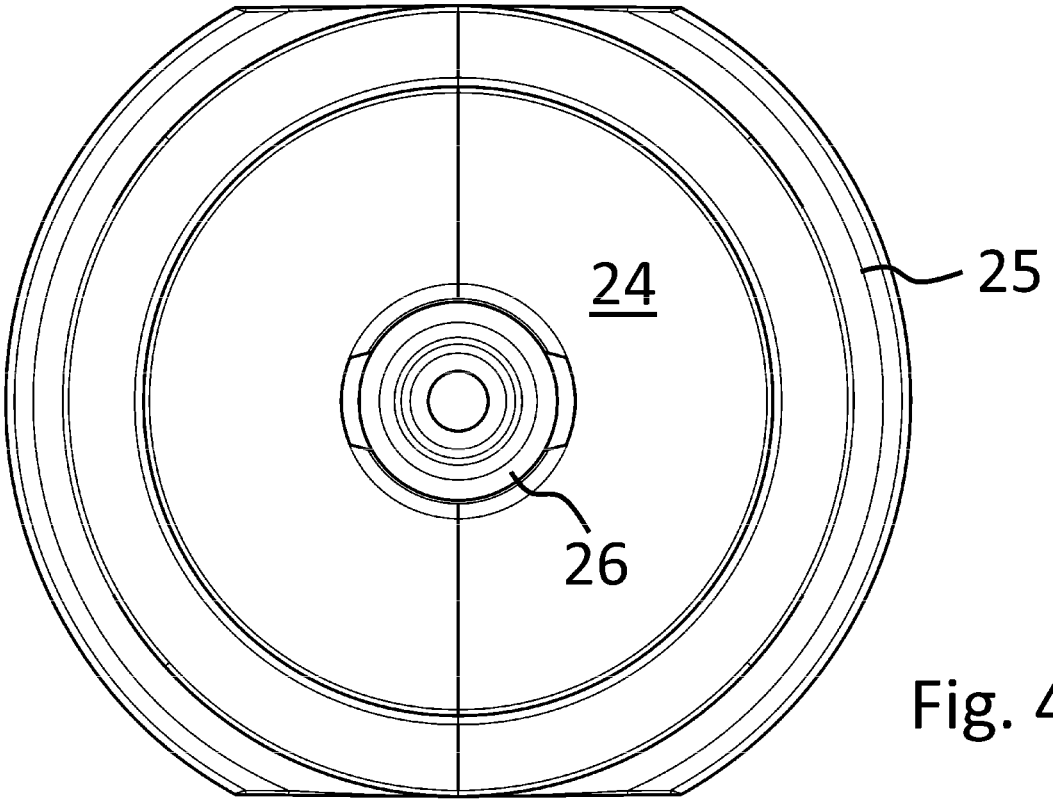
FIG. 4 shows a top view of the adapter of FIGS. 1-3.
Figure 5:
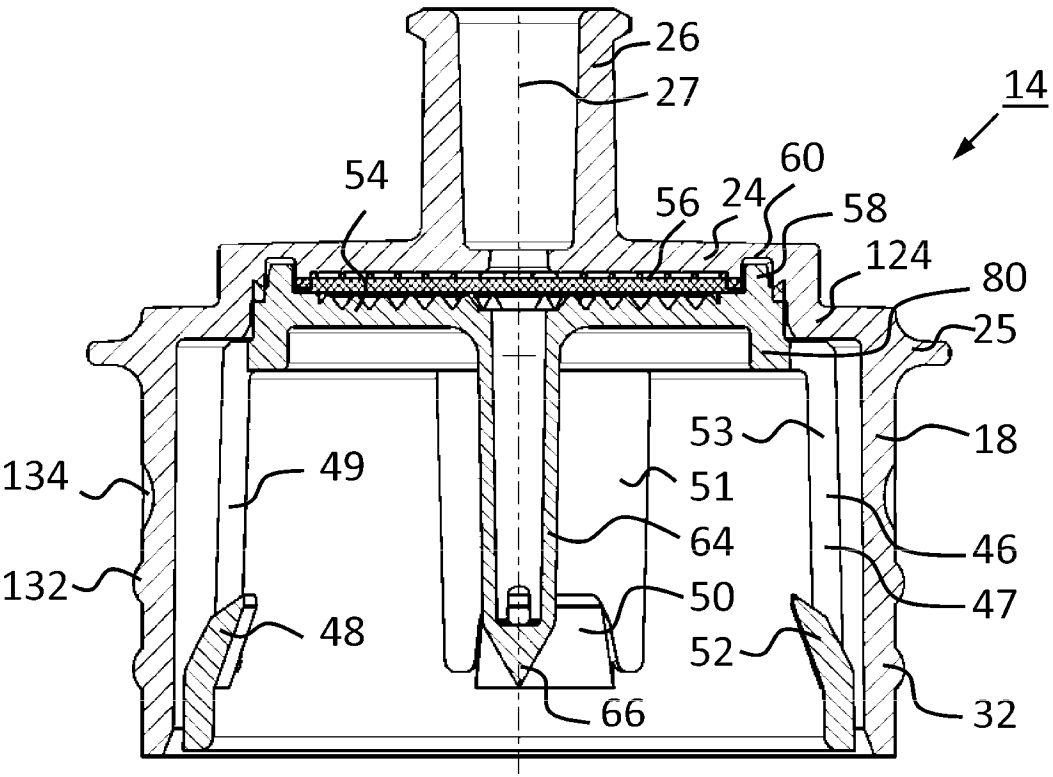
FIG. 5 shows a longitudinal sectional view of the adapter of FIGS. 1-4.
Figure 6:
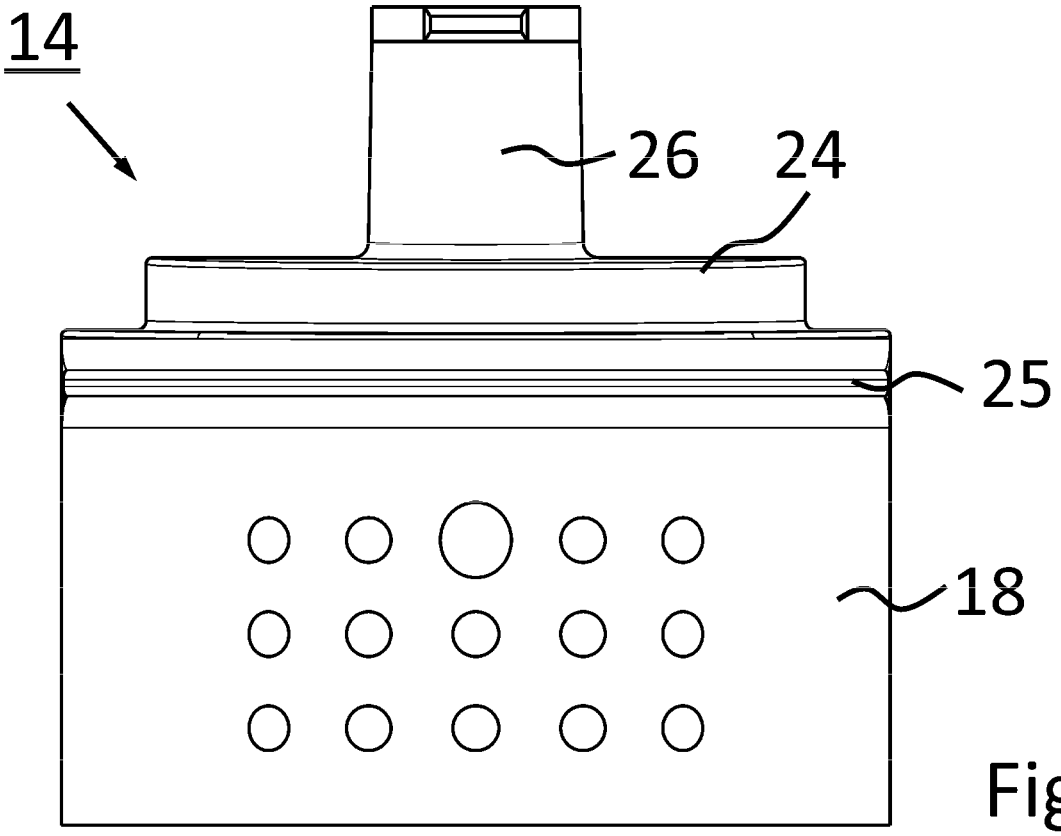
FIG. 6 shows a lateral view of the adapter of FIGS. 1-5.

As shown in FIGS. 3 and 5, an insert 46 is incorporated into the outer body 18 and is connected in particular with a material bond to the end wall 24 and preferably is connected to the latter continuously along the circumference. The insert 46 comprises a circumferential wall 47, which extends coaxially to the outer circumferential wall 32 and consequently extends concentrically around the longitudinal axis of the outer body 18 and thus of the adapter 14. The longitudinal axis is marked by the dash-dotted line 27.

The insert 46 serves as receptacle or holder for the vial 10 to be secured in position. For this purpose, projections 48, 50, 52, which extend from the circumferential wall 47 of the insert 46 into the interior of the insert 46, can possess a hook-shaped geometry, i.e. a triangular geometry in a cross-sectional view, and after proper introduction of the vial 10 these projections engage behind the latter's beadlike rim in order to secure it in position.

In order to ensure adequate movability of the projections 48, 50, 52, the insert 46, i.e. the latter's circumferential wall 47, extends at least in the area of the projections 48, 50, 52, but preferably along the entire circumference at some distance to the interior side of the outer circumferential wall 32 of the outer body 18. Also provided are recesses 49, 51, 53, which extend between the projections 48, 50, 52 and the bottom wall 54 of the insert 46 that extends along the end wall 24.

When the outer body 18 is connected to the insert 46, the bottom wall 54 extends along the interior side of the end wall 24, whereby a two-dimensional filter 56 may be placed between the interior side of the end wall 24 and the exterior side of the intermediate wall 54. This is illustrated in FIG. 5. The filter 56 may be secured in position on the exterior side of the bottom wall 54 of the insert before the insert 46 is inserted into the outer body 18 and connected to the latter.

The bottom wall 54 and the end wall 24 extend perpendicular to the longitudinal axis 27.

In order to ensure a proper positioning of the insert 46, the bottom wall 54 comprises a ridge 58, which protrudes beyond the bottom wall's exterior side in a circumferential annular manner, and which can be inserted into a corresponding recess 60 in the end wall 24, to thusly facilitate a centering. But other centering measures are also feasible and fall within the scope of the invention. Centering means of these types also include centering means arranged at individual points. Furthermore, the insert 46 itself may possess in the area of the inner side of the step 124 a step-shaped geometry, which further ensures a desired coaxial alignment of the insert 46 relative to the outer body 18.

The bottom wall 54 merges into the circumferential wall 47 via a step 80, so that the insert 46 basically consists of two cylindrical sections, namely the section bordered by the bottom wall 54 and the outer hollow-cylindrical section of greater diameter, from which the projections 48, 50, 52 protrude radially inward.

In the area of the ridge-like projection 58, the insert 46 should be joined to the end wall 24 in a material-bond, in particular by ultrasonic welding, which ensures a leak-tightness for fluids between the insert 46 and the end wall 24.

Originating from the bottom wall 54, in the opposite direction than the female Luer Luck connector 26, is provided a plastic spike 64, which forms a hollow piercing needle, with a needle tip 66, which during insertion of the vial 10 into the insert 46 penetrates the former's seal, in order to create a connection via the female Luer Lock connector 26 to a syringe body, which is not illustrated and is connected to the Luer Lock connector 26.

The hollow piercing needle may also be referred to as hollow-needle body or cannula body or another such paraphrase, and preferably consists of plastic. So referring to the component as 'cannula' is not meant to necessarily imply that it is made of metal.

FIG. 5 illustrates that the contact surface, i.e. the exterior side of the bottom wall 54 of the insert 46, along which extends the filter 56, is textured, so that the fluid to be withdrawn spreads out before it reaches the not illustrated syringe body via the female Luer Lock connector 26.

The housing, i.e. the outer body 18, in particular consists of a polyolefin, in particular polypropylene. The wall thickness of the outer circumferential wall 32 can be in a range between 1.2 mm and 1.6 mm.

The sectional view of FIG. 5 further illustrates that the exterior surface of the outer circumferential wall 32 possesses nub-like projections and spherical-segmental depressions, which simplifies handling the outer body 18. These elements are marked as an example by the reference labels 132, 134.

Figure 7:
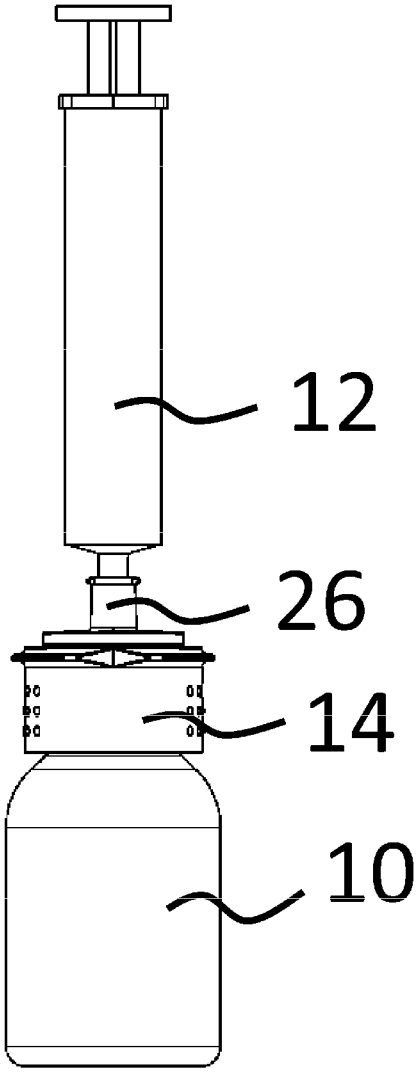
FIG. 7 shows the adapter of FIGS. 1-7 with a vial and a syringe body.

FIG. 7 shows the adapter 14, which on one side is connected to the vial 10 and on the other side is connected to the syringe body 12 via the female Luer Lock connector 26. As is known, the female Luer Lock connector 26 interacts with a male Luer Lock connector of the syringe body 12.

The invention claimed is:

1. An adapter for transferring a substance from a first container into a second container, the adapter comprising:

an interior circumferential wall, configured to accept a first container, along which extends a cannula body, at least partially encompassed by said interior circumferential wall;

a hollow-cylindrical section, which is connected to the cannula body, and is connectable to the second container;

wherein a longitudinal axis of the cannula body extends perpendicularly to one side of an end wall that extends transversely to the interior circumferential wall and the hollow-cylindrical section, and wherein the longitudinal axis extends perpendicularly to an opposing side of the end wall; and a cup-shaped outer body, comprising an exterior circumferential wall and the end wall, which extends transversely to the longitudinal axis of the outer body, wherein the cup-shaped outer body comprises an insert, having the interior circumferential wall that can accept the container, and a bottom wall, wherein the cannula body originates from the bottom wall of the insert, and the hollow-cylindrical section originates from the end wall of the cup-shaped outer body; and wherein the outer body and the insert are a unit, and are immovable with respect to each other along a longitudinal axis of the adapter.

2. The adapter according to claim 1, wherein the interior circumferential wall of the insert that is surrounded concentrically by the exterior circumferential wall of the outer body possesses projections, which extend radially into the interior of the insert and serve to secure the first container; and wherein, at least in the area of the projections, the interior circumferential wall extends at a distance to the inner surface of the exterior circumferential wall.

3. The adapter according to claim 1, wherein the bottom wall of the insert rests upon the end wall when the insert is connected to the cup-shaped outer body.

4. The adapter according to claim 3, wherein the bottom wall of the insert rests upon the end wall via an interposed filter element.

5. The adapter according to claim 1, wherein a centering element protrudes from the bottom wall of the insert, and extends oppositely to the interior circumferential wall, and which, when the hollow-cylindrical outer body is connected to the insert, engages into a matching receptacle in the end wall, or the reverse.

6. The adapter according to claim 5, wherein the centering element is embodied as an annularly extending ridge element, which engages into an annularly extending receptacle.

7. The adapter according to claim 1, wherein the exterior side of the bottom wall of the insert is textured by protrusions.

8. The adapter according to claim 1, wherein the insert comprises a first hollow-cylindrical section extending along the bottom side, and a second section of greater outer diameter that transitions via a step to form the interior circumferential wall, and wherein the centering element extends on the opposite side of the step.

9. The adapter according to claim 1, wherein the insert is connected circumferentially to the cup-shaped outer body in an air- or fluid-tight manner.

10. The adapter according to claim 1, wherein the insert is connected by way of a material bond to the bottom side of the cup-shaped outer body.

11. The adapter according to claim 1, wherein the interior circumferential wall of the insert is recessed, at least in sections, between the bottom wall, or the step, and the projection protruding radially inward.

12. The adapter according to claim 1, wherein the interior circumferential wall of the insert extends, at least in sections, at a distance to the inner surface of the exterior circumferential wall.

13. The adapter according to claim 1, wherein at least one of the cup-shaped outer body and the insert are injection-molded components.

14. The adapter according to claim 1, wherein the outer body possesses a flange-like rim, which projects radially beyond the exterior circumferential wall, and which is flattened in parts.

15. The adapter according to claim 1, wherein the end wall of the outer body serves as a termination at the end face of the adapter, and, from its center, projects the hollow-cylindrical section.

16. The adapter according to claim 1, wherein the outer body is connected to the insert by a material bond or a mechanical connection, and, together with the insert, forms a unit that accepts the first container.

* * * * *